US009281623B2

(12) United States Patent
Yuan et al.

(10) Patent No.: US 9,281,623 B2
(45) Date of Patent: Mar. 8, 2016

(54) ELECTRICAL CONNECTOR WITH A MATING PORT FOR DIFFERENT TRANSPORTING INTERFACES

(71) Applicant: HON HAI PRECISION INDUSTRY CO., LTD., New Taipei (TW)

(72) Inventors: Wei Yuan, Shenzhen (CN); Yu-San Hsiao, New Taipei (TW); Shih-Wei Hsiao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/260,212

(22) Filed: Apr. 23, 2014

(65) Prior Publication Data

US 2014/0322980 A1 Oct. 30, 2014

(30) Foreign Application Priority Data

Apr. 24, 2013 (CN) ..... 2013 2 02118047 U

(51) Int. Cl.
*H01R 24/00* (2011.01)
*H01R 13/6471* (2011.01)

(52) U.S. Cl.
CPC ..... *H01R 13/6471* (2013.01)

(58) Field of Classification Search
CPC .... H01R 12/71; H01R 12/722; H01R 12/732; H01R 24/58; H01R 13/6471; H01R 13/648
USPC ..... 439/79, 607.23, 607.4, 607.36, 626, 439/941, 108
See application file for complete search history.

(56) References Cited

U.S. PATENT DOCUMENTS 5,525,067 A * 6/1996 Gatti ..... H01R 23/6873 439/108
6,447,317 B1 * 9/2002 Billman ..... H01R 23/72 439/108
6,619,984 B2 * 9/2003 Liu ..... H01R 13/6594 439/607.4
6,932,646 B2 * 8/2005 Sloey ..... H01R 13/6581 439/607.4
6,969,268 B2 * 11/2005 Brunker ..... H01R 23/688 439/108
7,192,297 B1 * 3/2007 Wu ..... H01R 12/592 439/353
7,448,884 B2 * 11/2008 Kato ..... H01R 23/6873 439/108
7,510,406 B2 * 3/2009 Dong ..... H01R 12/7011 439/79
7,651,343 B2 * 1/2010 Zhu ..... H01R 12/7047 439/569

(Continued)

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

An electrical connector defines perpendicular first direction and second direction and includes a housing and a plurality of contacts. The housing includes a base portion and a first mating portion. The mating portion defines opposite first mating face and second mating face. The contacts are arranged in the housing in the second direction and include mating portions respectively exposed upon the first mating face and the second mating face and tails protruding from the housing. The contacts include several high-speed signal groups and each includes a pair of signal contacts and a grounding contact. The mating portions of the pair of signal contacts are located at the second mating face while the mating portion of the grounding contact is located at the first mating face. Three mating portions of each high-speed signal group are shaped as a triangle from a view along the first direction.

14 Claims, 7 Drawing Sheets

(56) References Cited

U.S. PATENT DOCUMENTS

D610,550 S 2/2010 Iino et al.
7,670,151 B2 * 3/2010 Yang ..... H01R 12/7052 439/378
7,686,628 B2 * 3/2010 Lino ..... H01R 43/0256 439/108
7,726,983 B2 * 6/2010 Zhu ..... H01R 12/57 439/552
7,914,302 B1 * 3/2011 Zhu ..... H01R 13/41 439/79
7,946,887 B1 * 5/2011 Zhang ..... H01R 27/02 439/607.23
7,963,800 B1 * 6/2011 Chen ..... H01R 12/7047 439/607.27
7,985,080 B2 * 7/2011 Ai ..... H01R 12/712 439/570
7,993,161 B2 * 8/2011 Mao ..... H01R 12/7052 439/607.4
8,002,588 B1 * 8/2011 Zhu ..... H01R 12/716 439/660
8,007,289 B2 * 8/2011 Bandhu ..... H01R 13/6271 439/638
8,011,966 B1 * 9/2011 Tang ..... H01R 13/6461 439/638
8,727,796 B2 * 5/2014 Ngo ..... H01R 12/75 439/660
8,864,501 B2 * 10/2014 Lin ..... H01R 13/65807 439/607.4
2007/0149006 A1 * 6/2007 Wu ..... H01R 12/721 439/78
2008/0003862 A1 * 1/2008 Yuan ..... H01R 12/716 439/350
2008/0124959 A1 * 5/2008 Lino ..... H01R 12/725 439/108
2008/0176426 A1 * 7/2008 Zhu ..... H01R 12/721 439/79
2010/0035477 A1 * 2/2010 Yuan ..... H01R 12/79 439/638
2010/0317229 A1 * 12/2010 Chen ..... H01R 27/02 439/607.23
2011/0104915 A1 * 5/2011 Lin ..... H01R 13/65807 439/108
2011/0143597 A1 * 6/2011 Lee ..... H01R 12/7023 439/630
2011/0263162 A1 * 10/2011 Zhu ..... H01R 12/57 439/660
2012/0077389 A1 * 3/2012 Zhang ..... H01R 24/60 439/660
2012/0108109 A1 * 5/2012 Zhang ..... H01R 12/721 439/629
2013/0115814 A1 * 5/2013 Briant ..... H01R 12/716 439/607.08
2015/0111401 A1 * 4/2015 Guo ..... H01R 13/6596 439/95

* cited by examiner

| Number | Name | Function |
|---|---|---|
| 1 | PC5V | HDMI |
| 2 | TMDS_TX_2+ | HDMI |
| 3 | GND | HDMI |
| 4 | TMDS_TX_2- | HDMI |
| 5 | CEC | HDMI |
| 6 | TMDS_TX_1+ | HDMI |
| 7 | GND | HDMI |
| 8 | TMDS_TX_1- | HDMI |
| 9 | HPD | HDMI |
| 10 | TMDS_TX_0+ | HDMI |
| 11 | GND | HDMI |
| 12 | TMDS_TX_0- | HDMI |
| 13 | SCL | HDMI |
| 14 | TMDS_TX_C+ | HDMI |
| 15 | GND | HDMI |
| 16 | TMDS_TX_C- | HDMI |
| 17 | SDA | HDMI |
| 18 | HOST-USB+ | USB |
| 19 | GND | HDMI |
| 20 | HOST-USB- | USB |
| 21 | USB5V | USB |
| 22 | HOST-USB3-RX+ | USB |
| 23 | GND | USB |
| 24 | HOST-USB3-RX- | USB |
| 25 | GND | USB |
| 26 | HOST-USB3-TX+ | USB |
| 27 | IO2 | IO |
| 28 | HOST-USB3-TX- | USB |
| 29 | GND | USB |
| 30 | USB+ | USB |

| Number | Name | Function |
|---|---|---|
| 31 | USB5V | USB |
| 32 | USB- | USB |
| 33 | GND | USB |
| 34 | USB3-RX+ | USB |
| 35 | IO3 | IO |
| 36 | USB3-RX- | USB |
| 37 | GND | USB |
| 38 | USB3-TX+ | USB |
| 39 | IO4 | IO |
| 40 | USB3-TX- | USB |
| 41 | GND | USB |
| 42 | IO1 | IO |
| 43 | IO5 | IO |
| 44 | IO6 | IO |
| 45 | IO7 | IO |
| 46 | LINE OUT+ | Audio |
| 47 | LINE OUT- | Audio |
| 48 | GND | Audio |
| 49 | DC OUT | DC-OUT |
| 50 | DC OUT | DC-OUT |
| 51 | DC OUT | DC-OUT |
| 52 | DC OUT | DC-OUT |
| 53 | GND | DC IN |
| 54 | GND | DC IN |
| 55 | GND | DC IN |
| 56 | GND | DC IN |
| 57 | DC IN | DC IN |
| 58 | DC IN | DC IN |
| 59 | DC IN | DC IN |
| 60 | DC IN | DC IN |

FIG. 7

ELECTRICAL CONNECTOR WITH A MATING PORT FOR DIFFERENT TRANSPORTING INTERFACES

FIELD OF THE INVENTION

The present invention generally relates to an electrical connector capable of high speed, and more particularly to an electrical connector with a mating port for different transporting interfaces.

DESCRIPTION OF RELATED ART

With the electric products turning slighter, thinner, shorter and smaller, the inner space of the electric product turns less and less. On the other hand, it is necessary to provide enough space to receive variety of electrical connectors for transporting signal of transport protocols. Usually, the different mating ports are arranged side by side or stacked one by one. However, it fails to decrease the inner space of the electric product.

In view of the foregoing, an electrical connector with a mating port for different transporting interfaces would be desirable.

SUMMARY OF THE INVENTION

Accordingly, an object of the present invention is to provide an electrical connector with a mating port for different transporting interfaces.

In order to achieve the object set forth, an electrical connector defines a first direction and second direction perpendicular to each other. The electrical connector comprises a housing and a plurality of terminals arranged in the housing in the second direction. The housing comprises a base portion and a first mating portion extending along the first direction. The mating portion defines opposite first mating face and second mating face. The contacts are divided into a first row and a second row. Each contact comprises a mating portion exposed on the mating portion and a tail protruding from the housing. Each row of the contacts comprises several high-speed signal groups. Each group comprises a pair of signal contacts and a ground contact. The contacting portion of each signal contact is located at the second mating face while the contacting portion of each ground contact is located at the first mating face. Three contacting portions of each high-speed signal group is shaped as a triangle from a view along the first direction.

Other objects, advantages and novel features of the invention will become more apparent from the following detailed description when taken in conjunction with the accompanying drawings.

BRIEF DESCRIPTION OF THE DRAWINGS

FIG. 7 is the arrangement chart of the contacts of the first electrical.

DETAILED DESCRIPTION OF THE INVENTION

Reference will now be made in detail to the preferred embodiment of the present invention.

Figure 1:
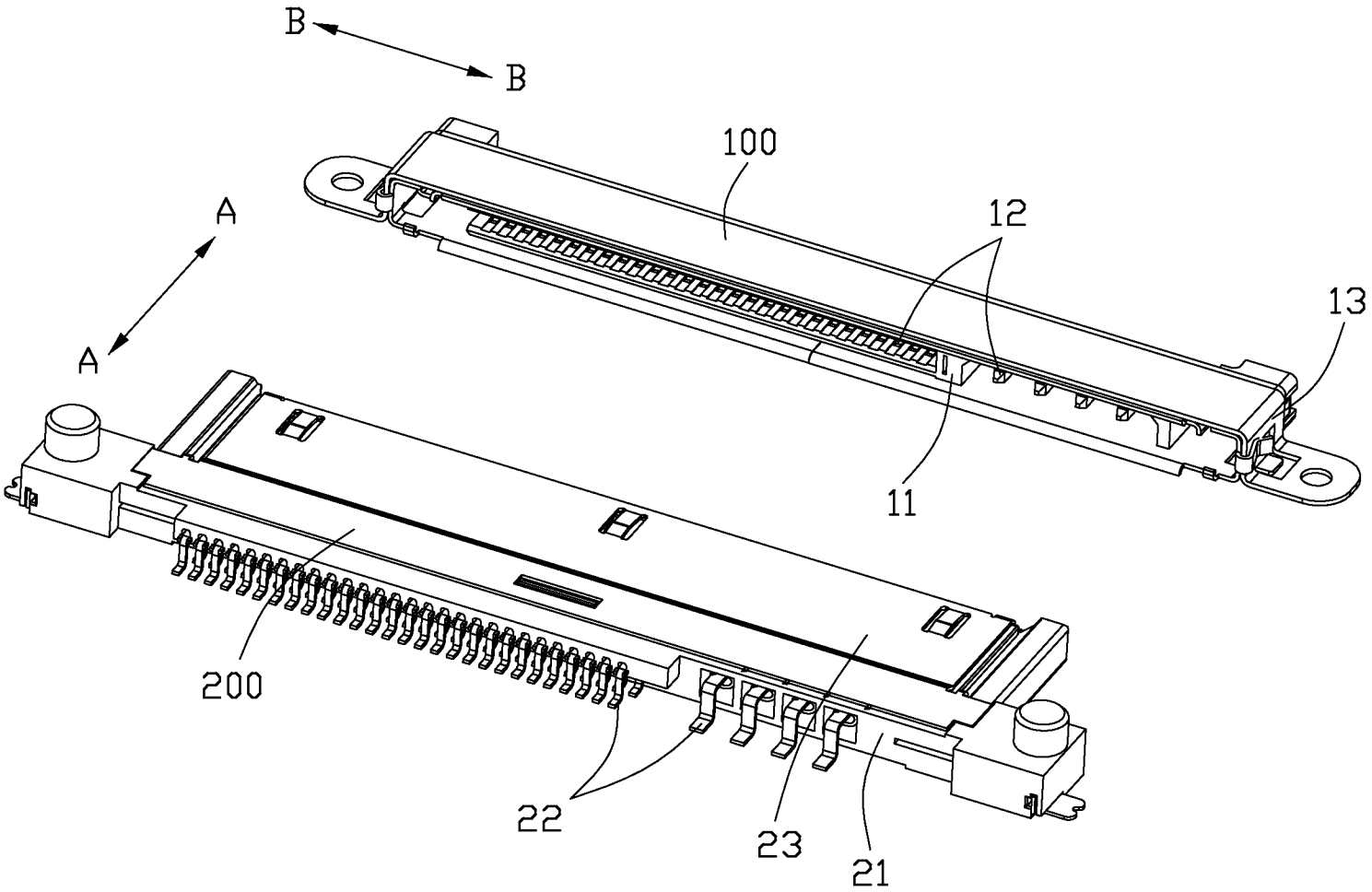
FIG. 1 is a perspective view of an electrical connector assembly of an embodiment in accordance with the present invention, wherein the first and second electrical connectors disconnect each other.

Referring to FIG. 1, an electrical connector assembly is provided for high-speed signal transported. The electrical connector assembly includes a first connector 100 and a second connector 200 mating with each other along a first direction (A-A, the mating direction) and respectively mounted onto two different PCBs (printed circuit board, not shown). The first electrical connector includes a first insulating housing 11, first contacts 12 arranged in a second direction (B-B) and a first shielding shell 13 made of metal. The second electrical connector includes a second insulating housing 21, second contacts 22 arranged in the second direction (B-B) and a second shielding shell 23 made of metal.

Figure 2:
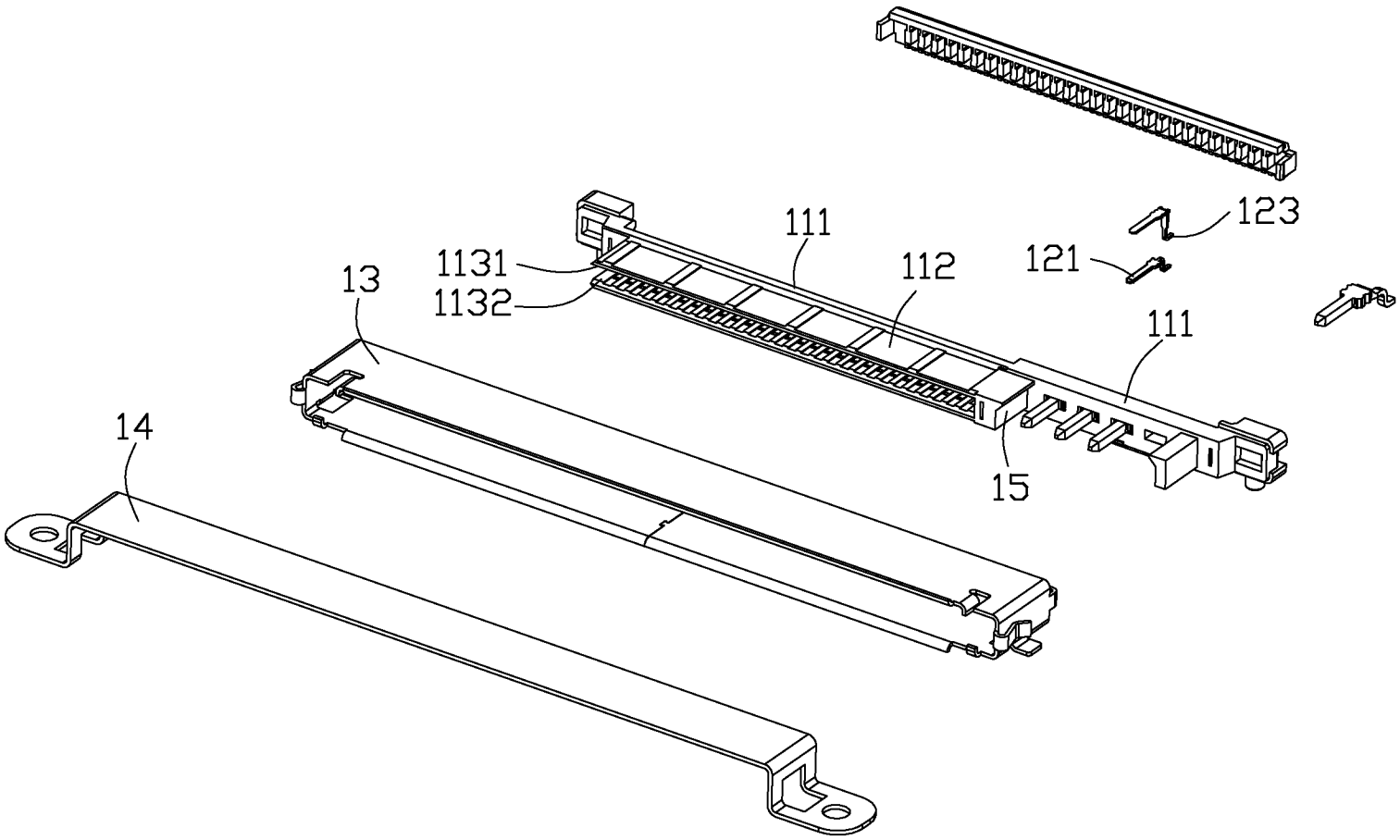
FIG. 2 is an exploded view of the first electrical connector shown in FIG. 1.
Figure 3:
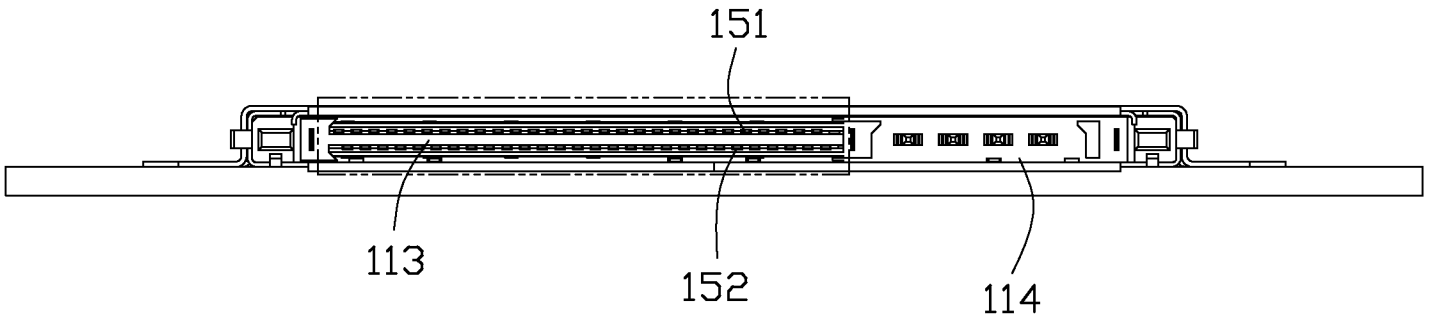
FIG. 3 is a front-to-back view of the first electrical connector shown in FIG. 2.

Referring to FIGS. 2 and 3, the first housing defines a base portion 111 and a mating portion 112 extending from the base portion along the first direction. The mating portion 112 includes a first mating portion 113 and a second mating portion 114 connected by a cross wall. The first mating portion 113 includes a first tongue 1131 and a second tongue 1132 parallel and opposite to each other. The two tongues 1131, 1132 are connected to each other by a side wall 15 at a first side while disconnected at an opposite side. The second mating portion 114 defines a mating space. The first contacts are arranged on the opposite inner faces of the first and second tongues. The first contacts comprise contacting sections 121 loaded on the first mating portion 113 and tails 123 mounted to the PCB. The first contacts assembled to the second mating portion 114 are pin-shaped and expose in the mating space to transport the power signal. The first mating portion 113 and the second mating portion 114 are surrounded by the first shell 13. A retaining element is attached to the first shell 13 and soldered to the PCB so as to increase the retaining force. The details on the arrangement of the contacts are illuminated as follows.

Figure 4:
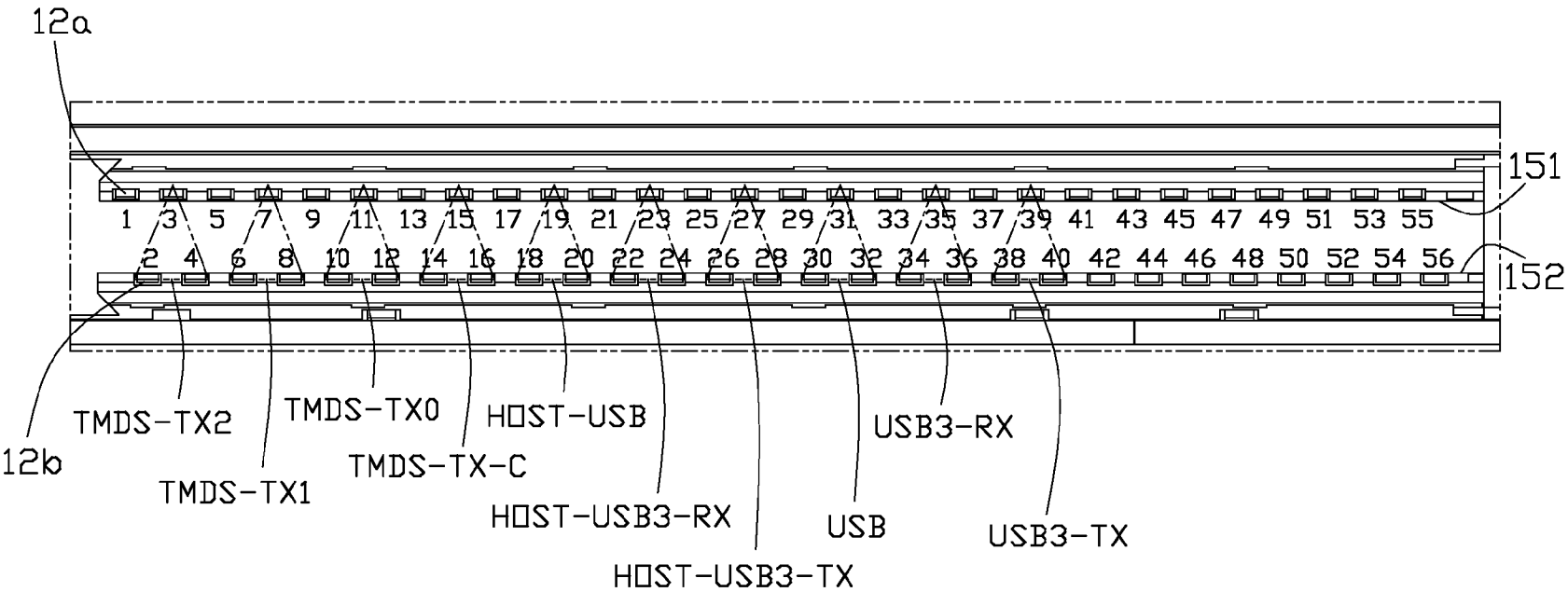
FIG. 4 is a partially enlarged view of the first electrical connector shown in FIG. 3.

Combination with FIGS. 3 and 4, the opposite inner faces of first mating portion 113 are defined as a first mating face 151 and a second face 152. The first contacts 12 are divided into a first row 12*a* (or an upper row, tagged by odd numbers) and a second row 12*b* (or a lower row, tagged by even numbers). The contacting sections of the first row 12*a* are arranged on the first mating face 151 while the contacting portions of the second row 12*b* are arranged on the second mating face 152. The contacting sections of first and second rows of contacts are in alternant arrangement from a view along the second direction. The first contacts 12 comprise ten groups of high-speed signal contacts and several low-speed signal contacts. Each group comprises a pair of differential signal contacts (such as P2, P4) and a grounding contact (such as P3). The pair of differential signal contacts is mainly to transport high-speed data signal with a purpose on enhancing the transporting speed. According to FIG. 4, contacting sections 121 of differential signal contacts are located at the second mating face 152 and contacting sections 121 of the grounding contacts are located at the first mating face 151. The contacting portions of each group high-speed signal contacts (including two differential signal contacts and a grounding contact) form a triangle in a front-to-back view. The low-speed signal contact (such as p1, 5, 9, 13, 17, 21, 15, 29, 33, 37) are located at the first mating face 151 and are stagger with grounding contacts (such as p3, 7, 11, 15, 19, 23, 27, 31, 35, 39) one by one. There are six groups to transport HDMI (High Definition Multimedia) signal and four groups to transport USB signal among the ten groups of high-speed signal contacts. The contacts p2-4 forms a TMDS-TX2 signal group. The contacts p6-8 forms a TMDS-TX signal group. The contacts p10-12 forms a TMDS-TX0 signal group. The contacts p14-16 forms a TMDS-TX-C signal group. Each signal group provides a transporting means. The contacts p18-20 forms a Host-USB signal group. The contacts p22-24 forms a Host-USB3.0-RX signal group. The contacts p26-28 forms a Host-USB3.0-TX signal group. The contacts 30-32 forms a USB2.0 signal group. The contacts p34-36 forms a USB3.0-RX signal group. The contact 38-40 forms a USB3.0-TX signal group. The low-speed signal contacts (p1, 5, 9, 13, 17, 21, 25, 29, 33, 37) arranged among the high-speed signal contacts comprises data contacts, detecting contacts, DC in contacts and audio contacts and so on. The contacts (p49-52), among other low-speed signal contacts (p41-56), are DC out contacts. The contacts could be added and arranged for multi functions.

The second mating portion 114 is assembled with several pin-shaped contacts (p57-60, shown in FIG. 7) to transport high-electrical-current signal.

The first mating portion is able to provide both HDMI-transmitting interface and USB-transmitting interface. At the same time, some other transmitting interfaces, such as Displayport, PCIe, are also available. By being compatible for multi transmitting interfaces, the first electrical is obviously able to lower the height of the whole electric system. What is more, every two signal pairs (especially high-speed ones) are spaced by a grounding contact. It is helpful to reduce the interference between signal pairs and improve the signal-transmitting quality.

Figure 5:
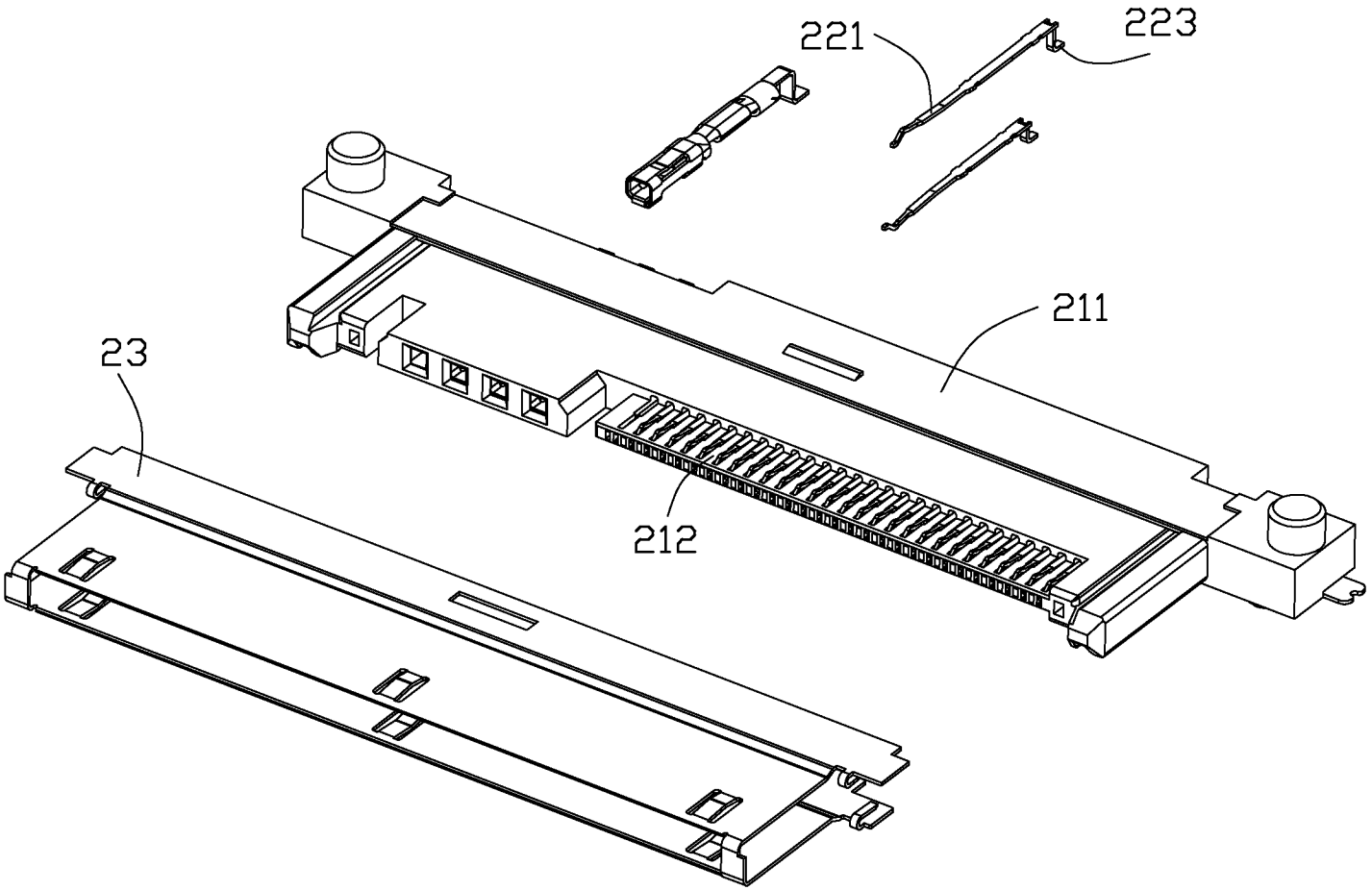
FIG. 5 is a partly exploded view of the second electrical connector shown in FIG. 1.
Figure 6:
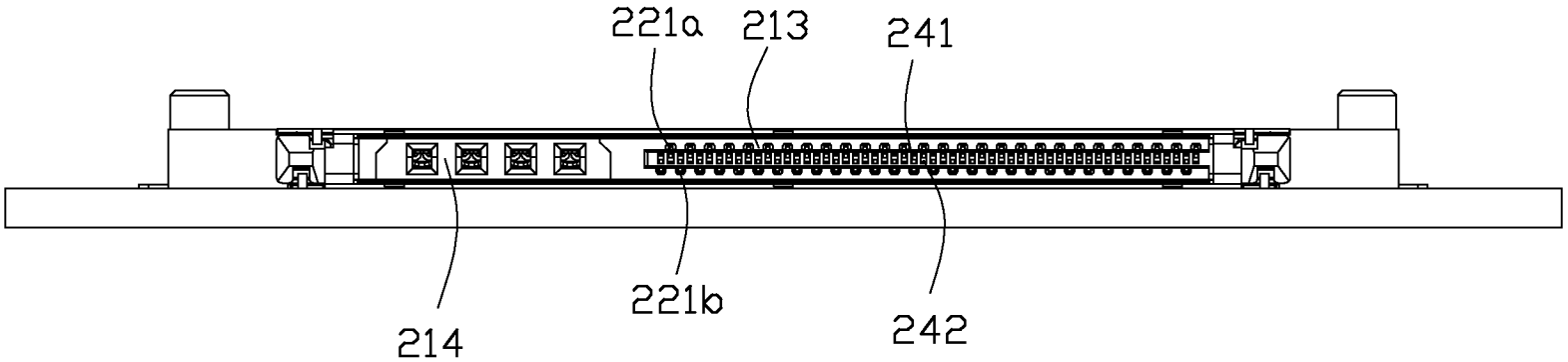
FIG. 6 is a front-to-back view of the second connector shown in FIG. 5.

Referring to FIGS. 5 and 6, the second insulating housing 200 of the second electrical connector 200 comprises a base portion 211 and a mating portion 212. The mating portion includes a first mating portion 213 and a second mating portion 214 extending along the first direction (A-A). The mating portion is shaped as a tongue and defines a first mating face 241 and a second mating face 242. The second contacts are arranged along the second direction (B-B). The contacts assembled on the first mating portion 213 comprises contacting portions 221 exposed at the first mating face 241 and tails 223 extending out of the second insulating housing 21. The contacting portions 221 are arranged in an upper row and a lower row. The contacting portions of the two rows are stagger with each other one by one from a view along a third direction perpendicular both the first and second directions. The contacts assembled on the second mating portion 214 are pipe-shaped and mated with the first pin-shaped contacts 12 to transmit power signal. The second shell surrounds the mating portion 212. Arrangement of the second contacts about each signal group isn't given necessary details for it is same as the first contacts.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector defining a first direction and a second direction perpendicular to each other, comprising:

a housing comprising a base portion and a first mating portion extending along the first direction, the first mating portion defines opposite first mating face and second mating face;

a plurality of contacts side by side arranged in the housing in the second direction and comprising mating portions respectively exposed upon the first mating face and the second mating face of the mating portion and tails protruding from the housing;

wherein the plurality of contacts comprises several high-speed signal groups and each group comprises a pair of signal contacts and a grounding contact;

wherein the mating portions of the pair of signal contacts of each high-speed signal group is located at the second mating face while the mating portion of the grounding contact of the high-speed signal group is located at the first mating face, three mating portions of each high-speed signal group is shaped as a triangle from a view along the first direction; wherein every two neighboring groups are aligned with each other in said second direction and commonly define a same orientation of said triangle in a third direction perpendicular to both said first direction and said second direction, wherein all the mating portions of the pairs of signal contacts are located at the second mating face and both the mating portions of the grounding contacts are located at the first mating face.

2. The electrical connector as claimed in claim 1, wherein the plurality of contacts are divided into a first row exposed upon the first mating face and a second row exposed upon the second mating face, the contacts of the first and second rows are alternately arranged from a view along the second direction.

3. The electrical connector as claimed in claim 2, wherein the plurality of contacts further comprise low-speed signal contacts, the mating portions of the low-speed signal contacts expose upon the first mating face and alternately arrange with the mating portions of the grounding contacts of the high-speed signal groups.

4. The plug electrical connector as claimed in claim 1, wherein said high-speed signal groups include four HDMI contact groups and six USB contact groups.

5. The plug electrical connector as claimed in claim 1, wherein the first mating portion comprises a first mating tongue and a second tongue spaced from each other, the two mating tongues each defines an inner face, the inner faces are facing to each other act as the first and second mating faces.

6. The plug electrical connector as claimed in claim 5, wherein several low-speed contacts are arranged adjacent to the high-speed contact group.

7. The electrical connector as claimed in claim 1, wherein the insulating housing comprises a second mating portion arranged with the first mating portion in a side by side manner along the second direction, several pin-shaped power contacts are arranged on the second mating portion.

8. The electrical connector as claimed in claim 7, wherein the first mating portion and the second mating portion are integrally connected to each other.

9. The electrical connector as claimed in claim 1, wherein the insulating housing comprises a second mating portion arranged with the first mating portion in a side by side manner along the second direction, several pipe-shaped power contacts are arranged on the second mating portion.

10. The electrical connector as claimed in claim 9, wherein the first mating portion is shaped as a tongue, the tongue defines two faces as the first mating face and the second face.

11. The electrical connector as claimed in claim 1, wherein the first mating portion is connected at a first end by a forwardly extending cross wall while disconnected at an opposite second end.

12. An electrical connector comprising:

an insulative elongated housing forming a center slot extending along a longitudinal direction;

opposite first and second rows of contacts disposed in the housing with corresponding contacting sections respectively located on two sides of the center slot in a transverse direction perpendicular to said longitudinal direction, and staggered with each other in said longitudinal direction;

the first row of contacts including a plurality of high speed differential pair contacts neighboring with one another along the longitudinal direction; and the second row of contacts including a plurality of grounding contacts and low speed signal contacts alternately arranged with each other; wherein each of said grounding contacts is located between the corresponding high speed differential pair contacts in said longitudinal direction while each of said low speed signal contacts is located between the neighboring two pairs of said high speed differential pair contacts along the longitudinal direction; wherein each of said grounding contacts and the corresponding high speed differential pair contacts are arranged in an isosceles triangle, and the neighboring isosceles triangles are oriented in a same transverse direction.

13. The electrical connector as claimed in claim 12, wherein each of the low speed signal contacts and the corresponding two neighboring high speed differential pair contacts are arranged in an isosceles triangle.

14. The electrical connector as claimed in claim 12, wherein the high speed differential pair contacts are of either USB or HDMI.

* * * * *